US010493783B2

(12) United States Patent
Sawicki et al.

(10) Patent No.: US 10,493,783 B2
(45) Date of Patent: Dec. 3, 2019

(54) COLLECTION SYSTEM FOR INK CO-SOLVENTS

(71) Applicant: Xerox Corporation, Norwalk, CT (US)

(72) Inventors: Paul F. Sawicki, Rochester, NY (US); John R. Uchal, Webster, NY (US); James E. Williams, Penfield, NY (US); Robert W. Phelps, Victor, NY (US); Christopher Douglas Atwood, Rochester, NY (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 15/938,070

(22) Filed: Mar. 28, 2018

(65) Prior Publication Data

US 2019/0299686 A1 Oct. 3, 2019

(51) Int. Cl.

| | |
|---|---|
| ***B41J 29/393*** | (2006.01) |
| ***B41J 29/377*** | (2006.01) |
| ***B41J 29/13*** | (2006.01) |
| ***B41J 29/46*** | (2006.01) |
| ***B41J 11/00*** | (2006.01) |

(52) U.S. Cl.

CPC ..... *B41J 29/377* (2013.01); *B41J 11/002* (2013.01); *B41J 29/13* (2013.01); *B41J 29/46* (2013.01)

(58) Field of Classification Search

None

See application file for complete search history.

(56) References Cited

U.S. PATENT DOCUMENTS

| | | | | |
|---|---|---|---|---|
| 4,953,364 | A * | 9/1990 | Lee | F24F 3/1405 415/220 |
| 6,354,015 | B1 * | 3/2002 | Ogasawara | B41J 11/002 34/60 |
| 7,433,627 | B2 | 10/2008 | German et al. | |
| 2014/0176635 | A1 * | 6/2014 | Portela Mata | B41J 29/377 347/19 |
| 2016/0138209 | A1 * | 5/2016 | Kitayama | D06F 58/24 34/499 |
| 2017/0185878 | A1 * | 6/2017 | Matsuo | G06K 15/4025 |

OTHER PUBLICATIONS

Sasaki Tsuneyuki, "Liquid Ejecting Apparatus", Apr. 15, 2015, European (Year: 2015).*

* cited by examiner

*Primary Examiner* — Matthew Luu
*Assistant Examiner* — Tracey M McMillion
(74) *Attorney, Agent, or Firm* — Fay Sharpe LLP

(57) ABSTRACT

An image forming apparatus includes a collection system for collecting vapor co-solvents that are a byproduct of liquid ink. In addition, the collection system collects dew condensation from the moist air that is generated by lamps that dry the ink on a substrate. The collection system can be located in an exhaust passage. A condenser is installed in parallel and in front of an exhaust fan in the exhaust passage. The exhaust fan directs a flow of air through the exhaust passage. The collection system also includes a removable waste bottle for collecting the dew condensation and the condensed co-solvents. The exhaust passage bifurcates into an exhaust duct that is located after the exhaust fan and which discharges dry air and a collection channel that is located in front of the exhaust fan and which carries liquid drip off to the removable waste bottle.

20 Claims, 4 Drawing Sheets

COLLECTION SYSTEM FOR INK CO-SOLVENTS

BACKGROUND

The present disclosure is directed to a collection system for collecting co-solvents in liquid ink that are a byproduct of the drying operation in an image forming apparatus, such as a printer. The present collection system is intended for use in an ink-jet printer, but is amenable to other marking systems as well.

Printing methods, such as xerographic and ink-jet printing methods, use fusing or curing as a way to provide image permanence. Ink-jet printing methods often use a water-based marking material or ink, which is applied to a substrate, such as paper. The water-based ink includes solvents. Other types of inks including non-water-based inks may also include solvents. The ink remains wet until it is air or heat dried. If printed pages are stacked without sufficient drying time, ink may smear or transfer to the adjacent sheet. Because incomplete dryness is liable to occur, it is necessary to quickly dry ink using a drying device.

Ink-jet printers employ a radiant feeder drying device, which includes radiant lamps that are positioned above the substrate. A rapid print speed (e.g., 180 sheets/minute) is used in combination with a high heat blast to dry the paper and the solvents.

However, heat and fumes are byproducts of the existing drying operation. Solvents that did not dry on the substrate are free-floating in the air. While exhaust ducts are dedicated to drawing out the heated air, nothing in the conventional drying device is dedicated to collecting solvents. Thus, the solvents tend to attach onto other mechanical components downstream.

An improved drying device is desired which would prevent any contamination of the mechanisms downstream, and which would reduce the required maintenance of the mechanisms that is caused by contaminates. An improved image forming apparatus is desired that captures the residual solvents that are a byproduct of the drying operation.

INCORPORATION BY REFERENCE

U.S. Pat. No. 6,354,015, entitled "Drying Device", by Fumihiko Ogasawara, et al., is totally incorporated herein by reference.

BRIEF DESCRIPTION

One embodiment of the disclosure is directed to an image forming apparatus that includes an image applying component for applying a marking material to a substrate in forming an image on the substrate. The image forming apparatus also includes at least one heating element for drying a substrate printed by the image applying component. The image forming apparatus also includes an exhaust passage located after the at least one heating element. The exhaust passage includes an exhaust fan for discharging moist air that is emanating from the print surface of the substrate. The image forming apparatus also includes a collection system located after the heating elements for collecting vapor co-solvents that are a byproduct of the marking material. The collection system collects vapor co-solvents from the air within the print zone, along with dew condensation from the moist air.

Another embodiment of the disclosure is directed to an image forming apparatus that includes a collection system for collecting solvents that are a byproduct of liquid ink. The collection system collects vapor co-solvents along with dew condensation from the moist air that is generated by lamps that dry the ink on a substrate. The collection system is located in an exhaust passage. A condenser is installed in parallel and in front of an exhaust fan in the exhaust passage. The exhaust fan directs a flow of the vapor filled air through the exhaust passage. The collection system also includes a removable waste bottle for collecting the liquid condensation and solvents. The exhaust passage bifurcates into an exhaust duct that is located after the exhaust fan and which discharges dry air and a collection channel that is located in front of the exhaust fan and which carries liquid drip off to the removable waste bottle.

Yet another embodiment of the disclosure is directed to a collection system for drying a substrate that has been marked by a marking material in an image forming apparatus. The collection system includes an exhaust passage located after a heating element that is used to dry the marking material. An exhaust fan is located in the exhaust passage for discharging moist air that contacts a print surface of the substrate. The collection system further includes a condenser, which is located after the heating element. The collection system collects vapor co-solvents that are a byproduct of the marking material. In addition, the condenser collects dew condensation from the moist air.

BRIEF DESCRIPTION OF THE DRAWINGS

The present disclosure is best understood from the following detailed description when read in conjunction with the accompanying drawing. It is emphasized that, according to common practice, the various features of the drawing are not necessarily to scale. On the contrary, the dimensions of the various features may be arbitrarily expanded or reduced for clarity. Like numerals denote like features throughout the specification and drawing.

DETAILED DESCRIPTION

The present disclosure is directed to a collection system for collecting co-solvents in marking material that are a byproduct of the drying operation in an image forming apparatus.

As used herein, an "image forming apparatus", refers to a marking device or system, a "printer," "printing assembly" or "printing system" or one or more devices used to generate "printouts" or a print outputting function, which refers to the reproduction of information on "substrate media" for any purpose. A "printer," "printing assembly" or "printing system" as used herein encompasses any media handling assembly or apparatus, such as a digital copier, bookmaking machine, facsimile machine, multi-function machine, etc. which performs a print outputting function. The printer can be an ink-jet printer, in which liquid marking material is applied to substrate. The marking material forms an image on the substrate.

As used herein, "substrate" refers to, for example, paper, transparencies, parchment, film, fabric, plastic, photo-finishing papers or other coated or non-coated substrates on which information can be reproduced, preferably in the form of a sheet or web. While specific reference herein is made to a sheet or paper, it should be understood that any substrate media in the form of a sheet amounts to a reasonable equivalent thereto.

Figure 1:
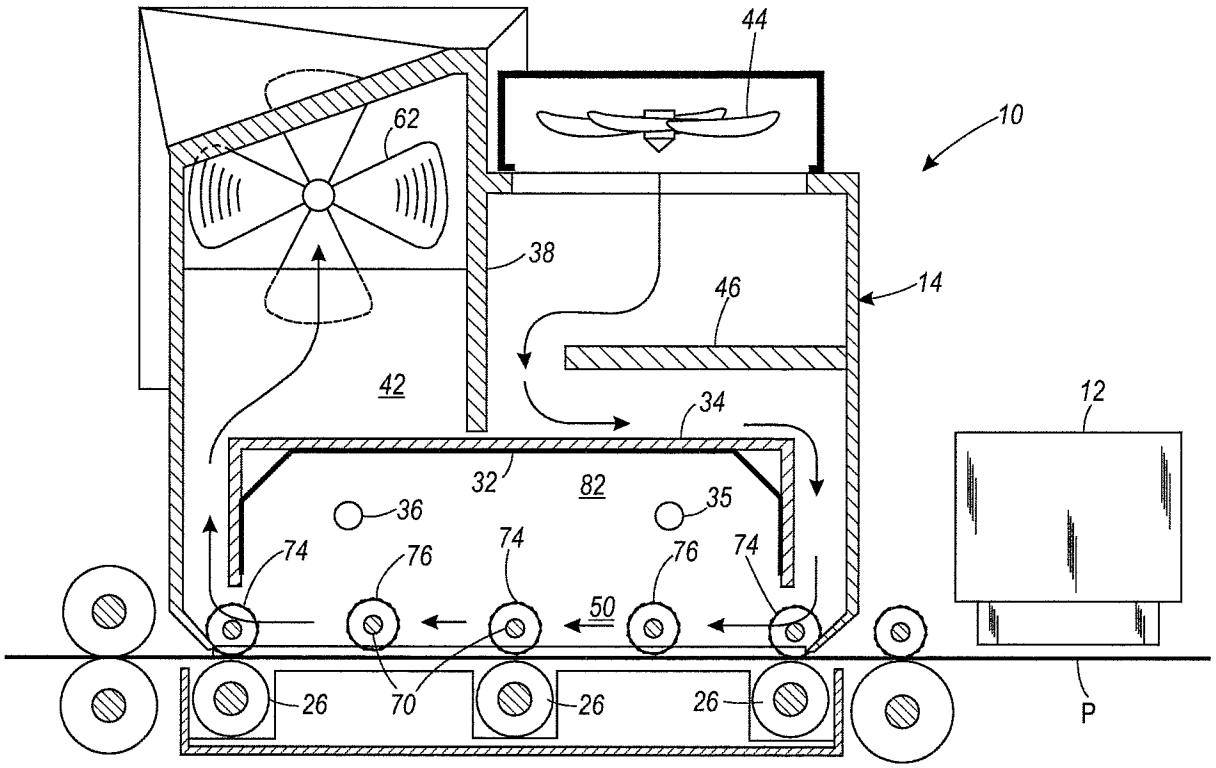
FIG. 1 PRIOR ART
FIG. 1 is side sectional view of a drying device according to the PRIOR ART.

Ink jet printers often have ink cartridges containing ink in liquid or solid form. At least one of the inks includes a radiation curable material ("solvent"). They also include drying devices for drying the substrate that is printed by the ink jet head. An irradiation system or drying device may also be incorporated in the marking device or positioned downstream of the marking device to receive the substrate therefrom. The collection system can be incorporated into a conventional drying device. FIG. 1 illustrates an example PRIOR ART drying device that is incorporated into an image forming apparatus (not shown) or marking system. One embodiment of a drying device is described in U.S. Pat. No. 6,354,015, entitled "Drying Device", which is totally incorporated herein by reference. However, no limitation is made herein to any one embodiment.

The drying device is disposed adjacent to an ink jet head 12. The ink jet head(s) 12 is mounted on a carriage (not shown) and applies ink to substrate P. Transport roller 26 and guide wheels 74, 76 transport the substrate to the drying device. The drying device is contained in a housing 14, which has an open base (drying region). A substantially channel-like reflector 32 is disposed in the central part of the housing 14. In the interior of the reflector 32, heating elements 35, 36 (or irradiation elements) are disposed along the transport direction of the substrate P. In one embodiment, the heating elements 35, 36 can include halogen lamps. Near infrared light of the halogen lamps 35, 36 is reflected toward the substrate P. Near infrared light and radiation heat are concentrated so that the substrate P is evenly dried.

An airflow is kept from entering the reflector 32 to generate a turbulent flow. Airflow passes around the reflector holder 34 and is guided through a blowing space 50 formed between the heating elements 35, 36 and the transport path surface of the substrate P. Therefore, the wind velocity in the blowing space 50 becomes constant so that the substrate P can be evenly dried.

More specifically, an inlet fan 44 pulls in outside air. The inlet fan 44 is disposed above the housing 14. The air is then fed into the housing 14. Once the air strikes the partition plate 46, it passes between the end of the partition plate 46 and the partition wall 38. The velocity of the air is equalized as it passes between the partition plate 46 and the reflector holder 34, and is guided toward the substrate P. Meanwhile, the air is slightly warmed by heat that is conducted to the reflector holder 34. Subsequently, hot air is guided to the blowing space 50. The hot air is rectified by the reflector 34, so that the velocity of the air is constant through the drying region 82.

As the substrate P is transported on the platen, the ink is dried by the radiation heat of the halogen lamp and the hot air warmed by the halogen lamp. Further, outside air flows around the reflector holder 34 to prevent the halogen lamp 35 from overheating. The air temperature raises as it moves downstream. The hot air, which passes above the platen, is discharged through an exhaust passage 42.

A longitudinal end of the exhaust passage 42 is provided with an exhaust fan 62. Therefore, the moist air contacting the print surface of the substrate P is quickly discharged from the drying device to prevent any dew condensation in the housing. Another aspect of the exhaust passage is to prevent the substrate from scorching, since the heating elements 35, 36 raise the temperature of the air that is circulating through the housing. The dryer device is dedicated to maintaining the overall temperature in the drying region, so the hot air that is generated by the high heat blast can be quickly discharged.

However, liquid ink is formed with a number of solvents. Among other reasons, the solvents prevent aggregation of the colorants during storage. The exhaust passage draws out the moist hot air with the solvents (which never dried) in it. The solvents start to collect and contaminate mechanisms (not shown) of the image forming apparatus that are located downstream from the drying device. These mechanisms—such as, the paper transport, paper baffles, rollers, curler rollers, etc.—develop a residue that shortens the lifespan of the components and increases the required maintenance of such mechanisms.

Figure 2:
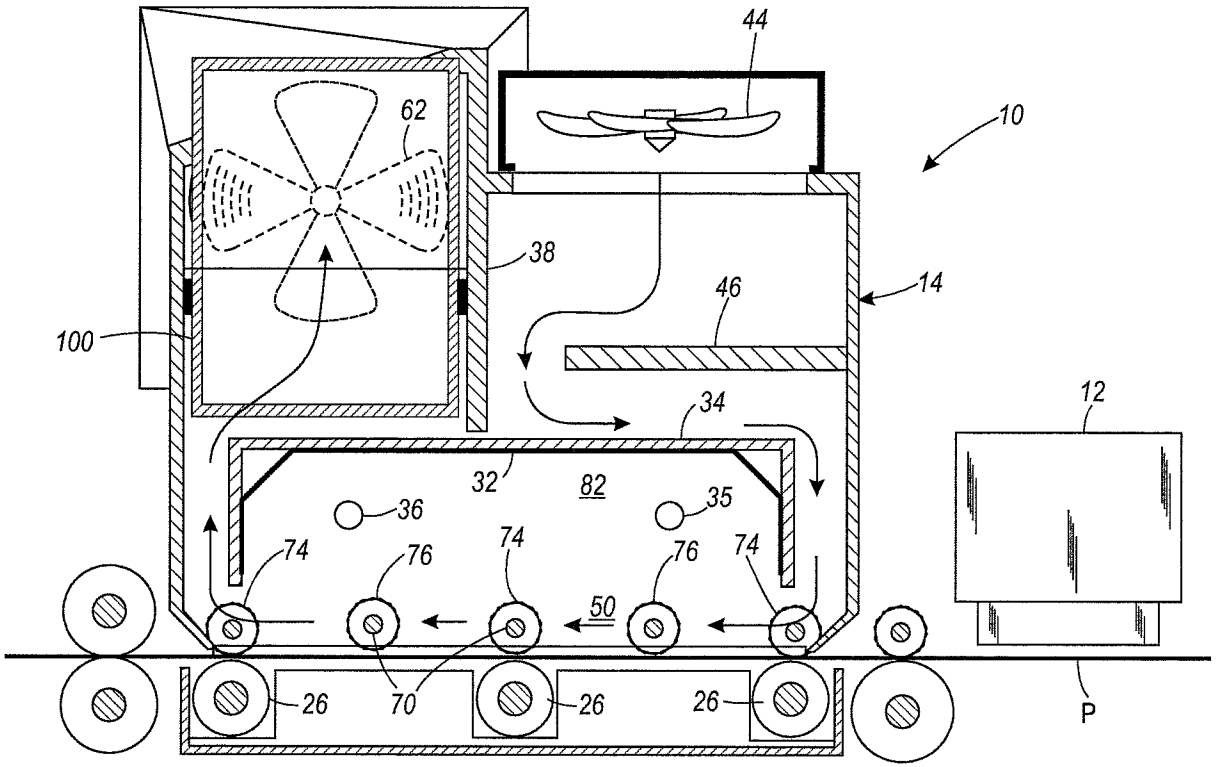
FIG. 2 is side sectional view of a collection system incorporated into the drying device of FIG. 1.

FIG. 2 illustrates an example collection system 100 according to one embodiment of the disclosure. The collection system is incorporated into an image forming apparatus (not shown) and, more specifically, and can be incorporated in the drying device 10 of an image forming apparatus. There is no limitation made herein to the exact configuration of the drying device. The disclosure contemplates that the collection system is incorporated into a radiant feeder drier of an ink jet printer. FIG. 2 shows the collection system incorporated in a proximity of the exhaust passage 42.

In one embodiment, the collection system 100 is positioned in the path of the warm moist air that is guided toward being discharged from the drying system 10. The exhaust passage 42 forms a generally unitary enclosure between the drying region 50 and the exhaust fan 62. The various components forming the collection system can be mounted to the inner wall surfaces forming the exhaust passage. There is no limitation made herein to the method of mounting. In the contemplated embodiment, the collection system can be located in front of the exhaust fan, which pulls the air outward to expel the hot air from the drying region. However, an embodiment is contemplated by which the collection system is accommodated within a section of the exhaust passage located after the exhaust fan.

FIG. 2 shows the exhaust fan 62 being positioned higher than the drying region 50 and transverse to and offset from the passage that coincides with the blowing space. One reason for this arrangement is to avoid any condensate from dropping on the substrate P as it is transmitted from the drying region to a finishing device (not shown) downstream. As discussed later, a location of the waste bottle should be removed from the transport path of the substrate, so that the substrate is not damaged by condensation.

Figure 3:
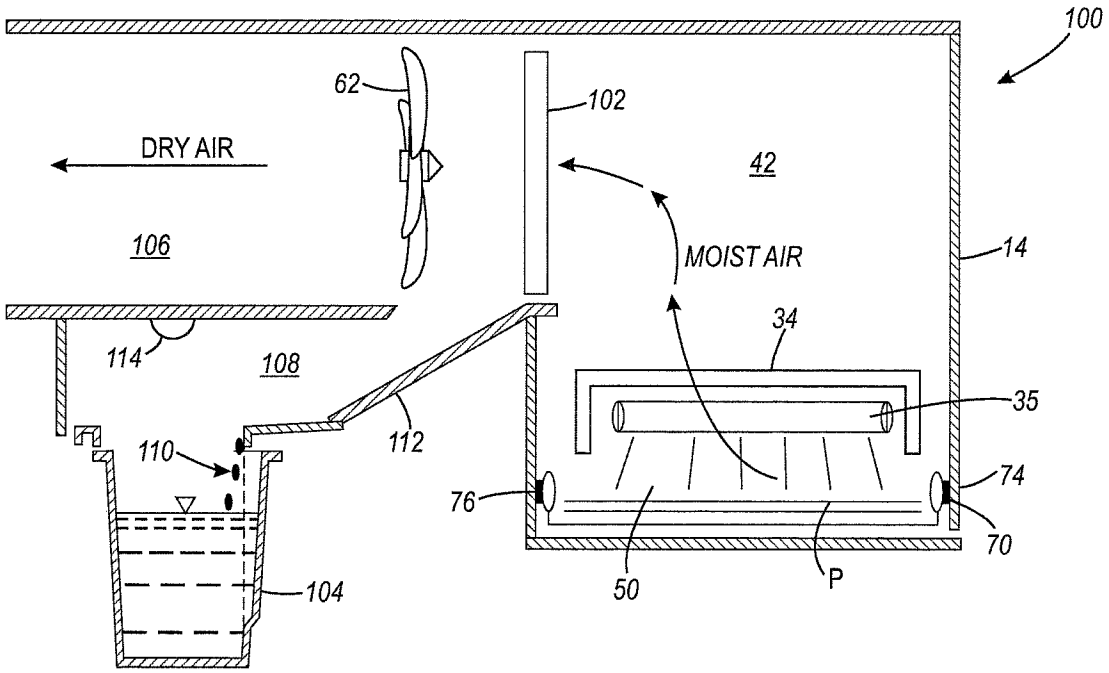
FIG. 3 is a side sectional view of a collection system according to one embodiment of the disclosure.

FIG. 3 is a side sectional view of a collection system according to one embodiment of the disclosure. In one embodiment, the collection system 100 includes a condenser 102. There is no limitation made to the thermal condensation operation of the collection system. In one example embodiment, a condenser 102 can be located directly in front of and, more specifically, parallel to the exhaust fan 62. The exhaust fan 62 pulls the warm moist air toward and through the condenser 102. As the warm moist air passes the condenser, the warm moist air turns into a liquid state. Any condenser that is operative to cool down and condense the warm moist air can be incorporated in the present image forming apparatus.

Conventional condensers also require a coolant, such as cooling water or air that normally contacts the moving moist air. In one embodiment, the condenser can include a cool air flow that is outside the exhaust passage, and particularly cooling the exhaust passage. In the contemplated embodiment, the condenser can take the form of a series of coils that are transverse the direction of the exhaust passage, whereby cooling liquid is delivered to and flows through the coils. Accordingly, the condenser is in communication with the controller of the image forming apparatus, which controls the temperature and flow of any necessary coolant.

In another embodiment (FIG. 4), the collection system can include a dehumidifier. More specifically, the collection system 100 can include a condenser 102 and an evaporator 103. There is no limitation made to the thermal condensation operation of the collection system. In one example embodiment, the condenser 102 can be located directly in front of and, more specifically, parallel to the exhaust fan 62. The evaporator 103 can be located directly in front of the exhaust fan and, more specifically, parallel to the exhaust fan 62 and the condenser 102. The exhaust fan 62 pulls the air, which is received from the blowing space 50, toward and through the evaporator and then the condenser 102. As the air passes the dehumidifier 102, 103, condensate of residual solvent is formed. Any dehumidifier that is operative to collect the solvent byproduct can be incorporated in the present image forming apparatus.

The solvents are carried with the condensate to a removable waste bottle 104. Returning to FIG. 3, the exhaust passage 42 bifurcates to form an exhaust duct 106 and a collection channel 108. The exhaust duct 106 is located after the exhaust fan 62 and discharges the dry air from the drying device 10. The collection channel 108, or at least an entrance to the collection channel, is located before the exhaust fan and carries condensate droplets 110 to the removable waste bottle 104. FIG. 3 shows the collection channel being defined by a bottom of the exhaust passage 42. In one embodiment, the collection channel 108 can have a tapered profile toward a top of the waste bottle 104, where the condensate collects. In another embodiment, the bottom wall 112 of the collection channel 108 can also slope downward to cause the condensate to move to the waste bottle 104. The collection channel 108 empties into the waste bottle 104 or a similar performing collection tray. Free floating particulates of the solvents are captured within the condensate. In one embodiment, the condensate can be dried up and the waste bottle can collect and store the residual solvents.

Continuing with FIG. 3, the collection channel 108 terminates at the removable waste bottle 104. The collection system 100 can further include a sensor 114, which measures a level of condensate and/or solvent in the waste bottle 104. The sensor 114 transmits the measurement to a controller (not shown) of the image forming apparatus. The image forming apparatus of the present disclosure includes a waste bottle access door, access panel, or drawer (not shown) on the exterior housing, which provides a user with access to the removable (and/or replaceable) waste bottle 104. When the waste bottle 104 is full, it can be accessed by a user using the door that is connected to the housing of the image forming apparatus. A user can remove and seal the waste bottle 104 for disposal, and replace it with a clean, empty waste bottle.

Figure 4:
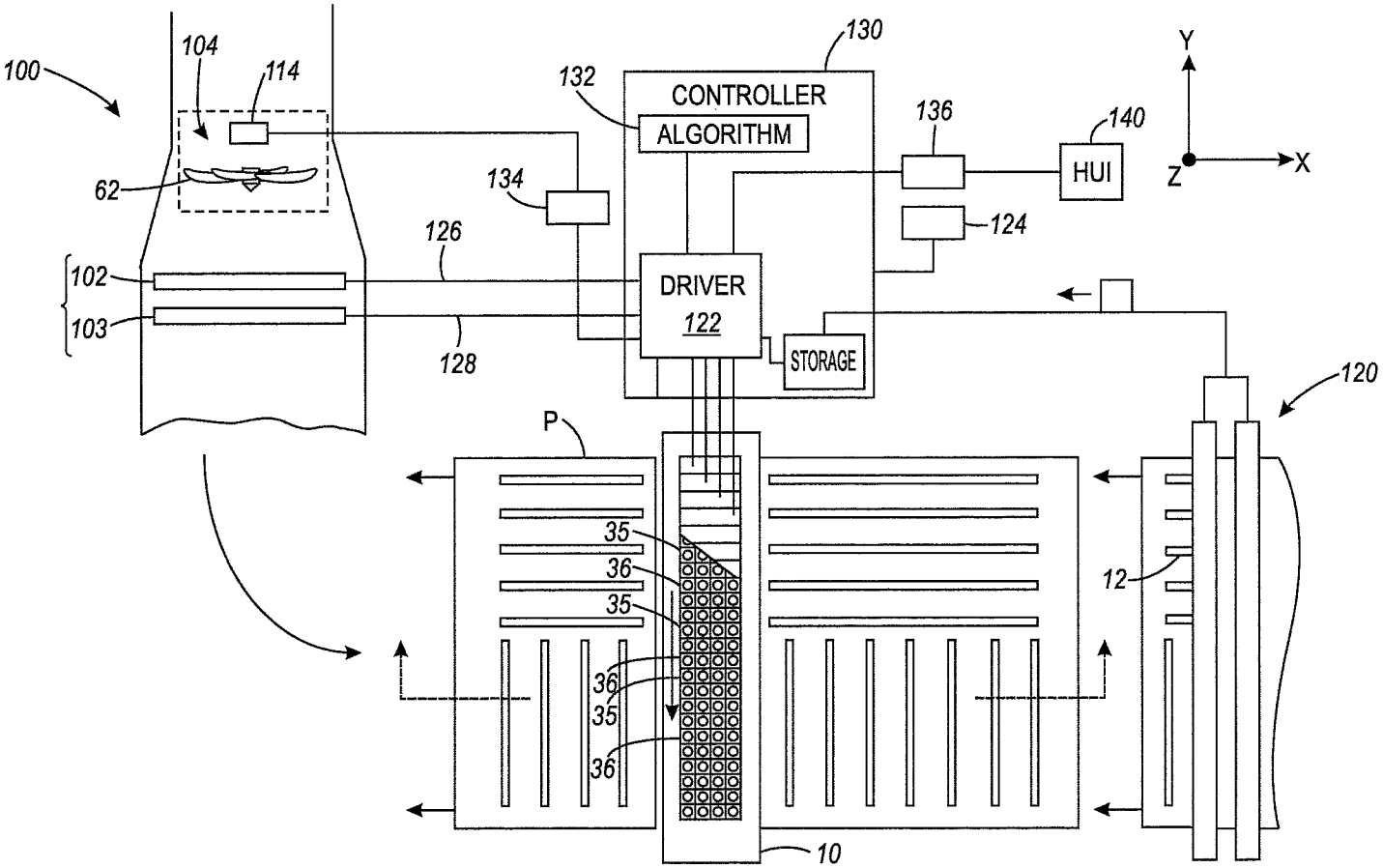
FIG. 4 is a schematic of a collection system according to an exemplary embodiment.

FIG. 4 is a schematic of the collection system in relation to the drying device and with the marking device 120. A coordinate system with X-Y-Z axes is shown for ease of reference. In general, the X axis corresponds to the transport direction or direction of travel and the Y-axis to the cross machine airflow direction, while the Z direction extends above and below the substrate P. As shown, the drying device 10 includes an array of addressable heating elements 35, 36. The heating elements 35, 36 are in radiative communication with the upper surface of the substrate P when the substrate P is passing by drying device 10. In general, the heating elements 35, 36 are slightly spaced from the substrate P in the z-direction.

After the drying operation, the substrate is further transported to a finishing device (not shown). The hot air that exits the blowing space rises in the z-direction, and toward the exhaust fan 62 (illustrated in the y-direction). The exhaust fan is operably (e.g., electrically) coupled to a programmable element driver (hereinafter "driver") 122, which in turn is operably (e.g., electrically) coupled to a power source 124. In the illustrated embodiment, the evaporator 103 and condenser 102 are connected to the driver 122 by links 126, 128, which may be a wired or wireless link for individual actuation.

The driver 122 is part of a single controller 130 that also includes a programmable processor 132. Controller 130 is coupled to the marking device 120, the drying device 10 and the collection system 100, and may be adapted to coordinate the operation of these and other elements of the image forming apparatus. In one embodiment, the coordinated operation of the controller 130 is achieved through a set of operating instructions (e.g., software) programmed into programmable processor 62.

In the operation of the marking system 120, the marking material is applied to the substrate P upstream from the drying device 10. The substrate proceeds from the marking device 120 to the drying device 10, whereby heating elements 35, 36 are activated by the driver 122 to irradiate the image. The substrate proceeds from the drying device to a finishing device (not shown). Simultaneously the solvents that did not dry on the substrate are pulled toward the exhaust duct by the exhaust fan 62. In one embodiment, the exhaust fan 62 is selectively activated by the driver 122 to operate during the periods, or for a predetermined amount of time thereafter, that the heating elements 35, 36 are actuated.

The driver 122 also actuates the condenser 102 and optionally an evaporator 103, depending on the need. Accordingly, the driver 122 controls the amount and temperature of coolant that is delivered to the condenser 102. As condensate fills up the waste bottle 104, the sensor 114 transmits a measurement 134 to the controller 130 via a wired or wireless connection. The processor 132 executes algorithms stored in the memory to determine if the waste bottle is full. In one embodiment, the processor 132 compares the level of condensate to a stored, predetermined threshold. In response to the level meeting or exceeding the predetermined level, the processor 132 generates an alert 136 to display on a graphic user interface 140 that is in wired or in wireless connection with the controller 130. At such time, the waste bottle 104 can be removed from the connection system 100 so that the condensed solvent can be appropriately discarded.

One aspect of the disclosure is to provide a collection system that collects and condenses area solvents so that they don't build up on downstream components. Another aspect of the disclosure is to provide a collection system that contains and allows for a disposal of residual solvents that do not dry on the substrate. A further aspect of the disclosure is to provide an improved image forming apparatus that requires less maintenance of downstream components.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. A image forming apparatus, comprising:

at least one image applying component for applying a marking material to a substrate in forming an image on the substrate;

at least one heating elements for drying a substrate printed by the at least one image applying component;

an exhaust passage located after at least one heating element;

an exhaust fan included in the exhaust passage for pulling moist air generated by the at least one heating element toward a condenser; and a collection system located below the exhaust passage after the condenser, the collection system for collecting condensate, wherein ink co-solvents that are a byproduct of the marking material are captured within the condensate, the collection system operative to further collect liquid dew condensation from the moist air.

2. The image forming apparatus of claim 1, wherein the marking material is a liquid ink.

3. The image forming apparatus of claim 1, wherein the marking material is formed from a water soluble solvent.

4. The image forming apparatus of claim 1, wherein the collection system includes:

a condenser installed in parallel and in front of the exhaust fan in the exhaust passage, the exhaust fan directing a flow of air through the exhaust passage.

5. The image forming apparatus of claim 1, wherein the collection system includes a removable waste bottle for collecting the liquid dew condensation and condensed ink co-solvents.

6. The image forming apparatus of claim 5 comprising a door for accessing the removable waste bottle.

7. The image forming apparatus of claim 6 further comprising:

a sensor in communication with a controller of the image forming apparatus, the sensor measuring a level of the liquid condensation in the removable waste bottle, the controller generating a warning on a GUI of the image forming apparatus in response to the level meeting and exceeding a predetermined threshold.

8. The image forming apparatus of claim 1, wherein the exhaust passage bifurcates to form (1) an exhaust duct being located after the exhaust fan and discharging dry air and (2) a collection channel being located before the exhaust fan and carrying liquid drip off to a removable waste bottle.

9. The image forming apparatus of claim 1, wherein the collection system is attached to the exhaust passage.

10. A collection system for drying a substrate having been marked by a marking material in an associated image forming apparatus, the collection system comprising:

an exhaust passage located after an associated heating element being used to dry the marking material;

an exhaust fan located in the exhaust passage for discharging moist air generated by the associated heating element drying the marking material on the substrate; and a condenser located after the associated heating element for turning the moist air into condensate;

a collection channel located partially below the exhaust passage and after the condenser, the collection channel for collecting the condensate, wherein ink co-solvents that are a byproduct of the marking material are captured within the condensate, the collection system operative to further collect liquid dew condensation from the moist air.

11. The collection system of claim 10, wherein the marking material is a liquid ink.

12. The collection system of claim 10, wherein the marking material is formed from at least one water soluble solvent.

13. The collection system of claim 10, wherein the condenser is installed in parallel and in front of the exhaust fan in the exhaust passage, the exhaust fan directing a flow of air through the exhaust passage.

14. The collection system of claim 10, wherein the condenser includes a removable waste bottle for collecting the liquid dew condensation and condensed ink co-solvents.

15. The collection system of claim 10, wherein the exhaust passage bifurcates to form an exhaust duct being located after the exhaust fan and discharging dry air and a collection channel being located before the exhaust fan and carrying liquid drip off to the removable waste bottle.

16. The collection system of claim 15 further comprising:

a sensor in communication with a controller of the associated image forming apparatus, the sensor measuring a level of the liquid condensation in the removable waste bottle, the controller generating a warning on an associated GUI of the associated image forming apparatus in response to the level meeting and exceeding a predetermined threshold.

17. The collection system of claim 10, wherein the condenser is mounted to an inner wall of the exhaust passage.

18. A image forming apparatus, comprising:

a collection system for collecting vapor co-solvents that are a byproduct of marking material, the collection system collects dew condensation from the moist air that is generated by drying the marking material on a substrate.

19. The image forming apparatus of claim 18, wherein the collection system is located in an exhaust passage.

20. The image forming apparatus of claim 19, wherein the collection system includes:

a condenser installed in parallel and in front of the exhaust fan in the exhaust passage, the exhaust fan directing a flow of air through the exhaust passage;

a removable waste bottle for collecting the dew condensation and condensed co-solvents;

an exhaust duct being located after the exhaust fan and discharging dry air; and a collection channel being located in front of the exhaust fan and after the condenser, the collection channel carrying liquid drip off to the removable waste bottle.

* * * * *